United States Patent [19]

Bierbaum et al.

[11] Patent Number: 4,718,580

[45] Date of Patent: Jan. 12, 1988

[54] STRUCTURE FOR FORMING A REFRACTORY JOINT OF PREDETERMINED THICKNESS BETWEEN A REFRACTORY NOZZLE AND A REFRACTORY PLATE

[75] Inventors: Eduard Bierbaum, Kaarst, Fed. Rep. of Germany; Walter Vetterli, Winterthur, Switzerland

[73] Assignee: Metacon AG, Zurich, Switzerland

[21] Appl. No.: 744,264

[22] Filed: Jun. 13, 1985

[30] Foreign Application Priority Data

Jun. 22, 1984 [DE] Fed. Rep. of Germany ..... 3423191

[51] Int. Cl.[4] ..... B22D 41/08

[52] U.S. Cl. ..... 222/600; 222/606; 222/598

[58] Field of Search ..... 222/606, 600, 599, 598, 222/591, 561, 590; 266/236, 271; 164/438, 337

[56] References Cited

U.S. PATENT DOCUMENTS

| | | | |
|---|---|---|---|
| 3,997,090 | 12/1976 | Tinnes | 222/590 |
| 4,037,762 | 7/1977 | Ruckstuhl | 222/591 |
| 4,219,188 | 8/1980 | Meier | 222/600 X |
| 4,249,680 | 2/1981 | Kimura et al. | 222/600 X |
| 4,327,847 | 5/1982 | Tinnes | 222/591 |

FOREIGN PATENT DOCUMENTS

| | | | |
|---|---|---|---|
| 2411800 | 9/1974 | Fed. Rep. of Germany | 222/598 |
| 2501458 | 7/1975 | Fed. Rep. of Germany | 222/600 |
| 2727742 | 1/1978 | Fed. Rep. of Germany | . |

*Primary Examiner*—Joseph J. Rolla
*Assistant Examiner*—Nils Pedersen
*Attorney, Agent, or Firm*—Wenderoth, Lind & Ponack

[57] ABSTRACT

A discharge structure includes a refractory plate, a mounting frame supporting the refractory plate, an exchangeable refractory nozzle, a mounting sleeve surrounding and supporting the nozzle, a lock between the sleeve and frame for locking the sleeve and the nozzle to the frame in a position with an inner end face of the nozzle urged toward a confronting surface of the refractory plate, and a refractory joint forming a seal between the end face and surface. An abutment extends from the frame and abuts an inner end of the nozzle, thus forming an axial support for the nozzle upon the lock urging the nozzle toward the plate, thus ensuring spacing between the end face and the surface by a predetermined distance and the resultant formation of the joint at a predetermined thickness.

9 Claims, 1 Drawing Figure

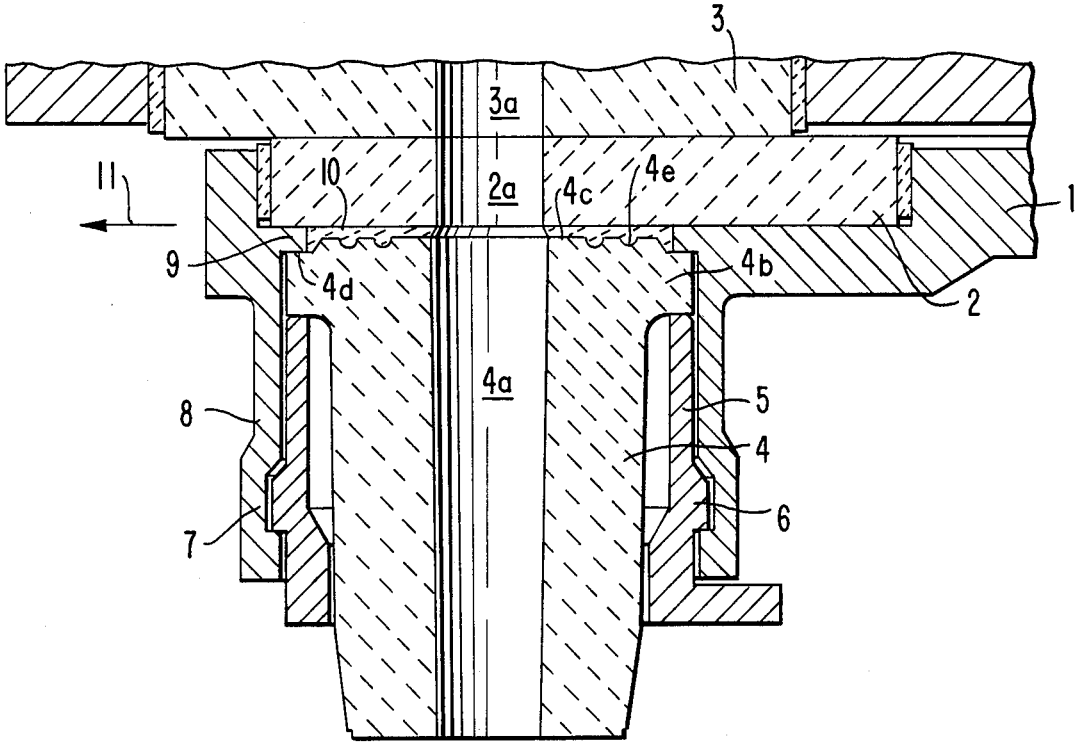
3
3a
2a
11
10
4c
4e
1
9
4d
4b
2
4a
8
5
4
7
6

STRUCTURE FOR FORMING A REFRACTORY JOINT OF PREDETERMINED THICKNESS BETWEEN A REFRACTORY NOZZLE AND A REFRACTORY PLATE

BACKGROUND OF THE INVENTION

The present invention is directed to a discharge apparatus, particularly for controlling the discharge of molten material from a metallurgical vessel, and including structure for forming a refractory joint of predetermined thickness between a refractory nozzle and a refractory plate. More particularly, the present invention relates to structure incorporated into a sliding closure unit or slide gate of the type including a movable refractory plate, a movable mounting frame supporting the refractory plate, an exchangeable refractory nozzle, a mounting sleeve surrounding and supporting the nozzle, and a bayonet connection or similar lock between the sleeve and the frame for locking the sleeve and the nozzle to the frame in a position with an inner end face of the nozzle urged toward a confronting surface of the refractory plate, with a refractory joint forming a seal between the end face of the nozzle and the confronting surface of the refractory plate.

This general type of structure is known, for example as disclosed in DE-OS No. 27 27 742. In known such structures, when mounting an interchangeable nozzle in position on a movable refractory plate, the inner end of the nozzle acts directly on the movable refractory plate via a refractory joint, for example formed of refractory cement or mortar. As a result, the formation of the refractory joint depends solely on a manual assembly operation, and it is seldom that the joint is optimally formed. In most cases, over tightening occurs, with the result that the contact pressure between the movable refractory plate and a stationary refractory plate mounted in contact therewith increases beyond a predetermined value, and at least beyond acceptable values. Particularly, additional stresses occur in the area of the discharge opening through the movable refractory plate. These stresses, together with thermal stresses prevailing during operation of the sliding closure unit, deleteriously effect the smoothness of movement of the movable refractory plate and can result in destruction of such plate, thereby requiring replacement of the movable refractory plate after a relatively short period of time. On the other hand, at times it occurs that the compression of the refractory joint during mounting of a refractory nozzle is insufficient to form a satisfactory seal. This results in dangerous leakage of molten material during operation.

SUMMARY OF THE INVENTION

With the above discussion in mind, it is the object of the present invention to provide an improved discharge structure of the above general type, but whereby it is possible to overcome the above and other prior art disadvantages.

It is a further object of the present invention to provide such a structure whereby the refractory joint may be formed to a predetermined thickness with a high degree of reproducibility upon replacement of the nozzle.

The above and other objects of the present invention are achieved by the provision of means for spacing the end face of the nozzle and a confronting surface of the movable refractory plate by a predetermined distance and thereby for forming the refractory joint of a predetermined thickness. Such spacing means is in the form of an abutment extending from the mounting frame and abutted by an inner end of the nozzle. The abutment thus forms an axial support for the nozzle upon the lock means urging the nozzle toward the movable refractory plate. As a result, each time the nozzle is replaced, it is possible to form a refractory joint of predetermined thickness, thereby avoiding the application of either excessive or insufficient pressure, and thereby ensuring a satisfactory seal while avoiding the application of undue stress to the movable refractory plate. It of course will be understood that the refractory cement or mortar forming the joint will be of a prescribed type and consistency, as would be apparent to one skilled in the art. It accordingly is possible to ensure that the contact pressure between the movable refractory plate and the stationary refractory plate in abutment therewith is not changed by the replacement of the refractory nozzle. Therefore, the wear of the movable refractory plate will be maintained within desired limits.

In accordance with one aspect of the present invention, the abutment may be in the form of an annular projection extending radially inwardly of the frame. This arrangement is relatively simple of construction and easily can be implemented. In many cases, upon the mounting of a new nozzle, it is necessary to enable excess refractory cement or mortar to flow from the joint. In such situations, the abutment in accordance with another aspect of the present invention is in the form of a plurality of projections extending radially inwardly of the mounting frame, the projections being equally annularly spaced from each other and defining therebetween radial openings for the passage of excess cement or mortar.

In accordance with a further feature of the present invention, the inner end of the replaceable refractory nozzle has a peripheral recess spaced axially from the inner end face and defining an annular surface which abuts the abutment. Also, the inner end face of the refractory nozzle may have formed therein at least one annular groove, preferably plural concentrically arranged annular grooves, thereby providing improved bonding of the refractory cement or mortar to the nozzle.

BRIEF DESCRIPTION OF THE DRAWING

Other objects, features and advantages of the present invention will be apparent from the following description, taken with the accompanying drawing, wherein:

The single FIGURE is a longitudinal section through the discharge area of a sliding closure unit incorporating the present invention.

DETAILED DESCRIPTION OF THE INVENTION

The structure of the present invention is contemplated as being adaptable to a sliding closure unit or sliding gate of generally conventional structure and including a stationary refractory plate 3 having therethrough a discharge opening 3*a*. A movable refractory plate 2 has therethrough a discharge opening 2*a* and is supported by a movable mounting frame 1 for movement in a direction indicated by arrow 11 between an open position as illustrated with discharge openings 2*a*, 3*a* in alignment, and a closed position, whereat the discharge openings are out of alignment. A tubular refractory discharge nozzle 4 is provided as a replaceable element and is mounted for movement with plate 2 with a discharge opening 4*a* in alignment with discharge opening 2*a*. Thus, mounting frame 1 has a tubular portion 8 into which is inserted nozzle 4, with a mounting sleeve 5 surrounding and supporting nozzle 4. A lock arrangement, such as a conventional bayonet type coupling 6, 7 is formed between the outer surface of sleeve 5 and the inner surface of tubular portion 8. The structure is such that when the lock means is operated, the sleeve 5 and therefore the nozzle 4 are urged upwardly as viewed in the drawing, such that an inner end face 4*c* of nozzle 4 is urged toward a confronting surface of plate 2. As illustrated, nozzle 4 has at the inner end thereof an outwardly extending flange 4*b* defining an axially outer surface abutted by an inner end surface of sleeve 5. Between the inner end face 4*c* of nozzle 4 and the confronting surface of plate 2, there is provided a refractory joint 10 to form a seal. Joint 10 is formed by conventional refractory cement or mortar materials as would be understood by one skilled in the art.

According to the present invention, there is provided structure for avoiding the above discussed prior art problems and specifically to define the refractory joint 10 of a predetermined thickness by spacing end face 4*c* a predetermined distance from plate 2. More particularly, this structure is in the form of an abutment 9 extending radially inwardly from mounting frame 1 and abutted by the nozzle 4, thus forming an axial support or bearing for the nozzle upon the lock structure urging the nozzle 4 toward the plate 2.

In accordance with one arrangement of the present invention, abutment 9 may be in the form of an annular projection. Alternatively, abutment 9 may be in the form of a plurality of radially inwardly extending projections which are spaced equally annularly from each other to define therebetween openings through which may pass excess cement or mortar material.

In accordance with a particularly preferred arrangement of the present invention, the inner end of nozzle 4 has formed therein a peripheral recess defining an annular surface 4*d* which is axially spaced from inner end face 4*c* and which abuts with abutment 9. Furthermore, the inner end face 4*c* may have formed therein at least one, and preferably a plurality of concentrically arranged, annular grooves 4*e*, thereby providing improved bonding of the cement material to the nozzle 4.

The drawing illustrates the sliding closure unit in the open, discharge position. Upon movement of the frame 1, plate 2 and nozzle 4 in the direction of arrow 11, the discharge opening is closed. At such time, for example at the end of each ladle charge, the nozzle 4 may be removed and replaced by a new nozzle. Specifically, a worn nozzle 4 is removed simply by operating sleeve 5 to unlock the bayonet-type coupling 6, 7. This allows axial withdrawal of the worn nozzle 4 and sleeve 5. Any residual mortar of joint 10 remaining on plate 2 is removed. A newly prepared interchangeable unit including mounting sleeve 5 and a new nozzle 4 having mortar applied to the inner end face 4*c* thereof can be readily inserted into tubular portion 8 and rotated while fastening the bayonet-type coupling 6, 7 until the surface 4*d* abuts with abutment 9. An advantage of a bayonet-type lock is that during this time the mortar will be spread or distributed over the confronting surfaces of plate 2 and nozzle 4. The above abutment will ensure that the inner end face 4*c* is spaced a predetermined distance from the confronting surface of plate 2. Therefore, when the mortar solidifies, the joint 10 will be formed of the predetermined thickness. The joint 10 absorbs allowed dimensional tolerances of refractory plate 2 and refractory nozzle 4, but nevertheless the abutment 9 prevents any undue mounting pressures from being transmitted to plate 2.

Although the present invention has been described and illustrated with respect to preferred features thereof, it is to be understood that various modifications and changes may be made to the specifically described and illustrated features without departing from the scope of the present invention.

We claim:

1. In a discharge structure, particularly for controlling the discharge of molten metal from a metallurgical vessel, of the type including a refractory plate, a mounting frame supporting said refractory plate, an exchangeable refractory nozzle, a mounting sleeve surrounding and supporting said nozzle, lock means between said sleeve and said frame for locking said sleeve and said nozzle to said frame in a position with an inner end face of said nozzle urged toward a confronting surface of said refractory plate, and a refractory joint forming a seal between said end face and said surface, the improvement of means spacing said end face and said surface by a predetermined distance and thereby for forming said joint of a predetermined thickness, said spacing means comprising:

abutment means, extending from said frame and abutted by an inner end of said nozzle, for forming an axial support for said nozzle upon said lock means urging said nozzle toward said plate.

2. The improvement claimed in claim 1, wherein said abutment means comprises an annular projection extending radially inwardly of said frame.

3. The improvement claimed in claim 1, wherein said abutment means comprises a plurality of projections extending radially inwardly of said frame, said projections being equally annularly spaced from each other.

4. The improvement claimed in claim 1, wherein said inner end of said nozzle includes a peripheral recess spaced axially of said inner end face and defining an annular surface abutting said abutment means.

5. The improvement claimed in claim 1, wherein said inner end face has formed therein at least one annular groove, thereby providing improved bonding of the material of said refractory joint.

6. The improvement claimed in claim 5, comprising plural, concentrically arranged said annular grooves.

7. The improvement claimed in claim 1, wherein said inner end of said nozzle includes an outwardly extending flange having an axially inner surface abutting said abutment means and an axially outer surface abutted by an end surface of said sleeve.

8. The improvement claimed in claim 1, wherein said frame includes a tubular portion surrounding said sleeve, and said lock means comprises a bayonet-type coupling between an inner surface of said tubular portion and an outer surface of said sleeve.

9. The improvement claimed in claim 1, wherein said plate and said frame comprise movable elements of a sliding closure unit.

* * * * *